United States Patent [19]

Gidley

[11] 4,123,572

[45] Oct. 31, 1978

[54] CUTTING SHEET MATERIAL HAVING TACKY LAYER THEREON

[75] Inventor: John A. F. Gidley, Sutton Coldfield, England

[73] Assignee: Imperial Metal Industries (Kynoch) Limited, Birmingham, England

[21] Appl. No.: 716,455

[22] Filed: Aug. 23, 1976

[30] Foreign Application Priority Data

Sep. 2, 1975 [GB] United Kingdom ..... 36124/75

[51] Int. Cl.[2] ..... B05D 3/12; B05D 1/32

[52] U.S. Cl. ..... 427/272; 96/86 P; 101/463; 427/293; 427/358; 427/388 R

[58] Field of Search ..... 427/272, 293, 178, 207 C, 427/358, 388 R; 118/38, 40, 41, 42, 43; 156/247; 101/463; 96/86 P

[56] References Cited

U.S. PATENT DOCUMENTS

| | | | |
|---|---|---|---|
| 876,010 | 1/1908 | Overbury | 118/38 X |
| 1,581,040 | 4/1926 | Vannote | 427/293 X |
| 3,096,195 | 7/1963 | Seman et al. | 427/272 |
| 3,476,584 | 11/1969 | Randklev et al. | 427/178 |

FOREIGN PATENT DOCUMENTS

| | | | |
|---|---|---|---|
| 561,229 | 8/1958 | Canada | 427/272 |
| 865,491 | 4/1961 | United Kingdom | 427/207 C |

*Primary Examiner*—Harry J. Gwinnell
*Assistant Examiner*—Evan K. Lawrence
*Attorney, Agent, or Firm*—Cushman, Darby & Cushman

[57] ABSTRACT

A continuous method of manufacturing a plurality of sheet material blanks each having a surface uniformly coated with a tacky layer comprises passing a long length of the sheet material through a first station in which tapes are applied to a surface of the sheet material transversely to the direction of movement of the sheet material and at longitudinally spaced-apart locations, at a second station applying a continuous layer of tacky material to the surface of the sheet material and over the tapes so that tapes mask portions of the surface, at a third station removing the tapes to leave transverse regions free of tacky material and then cutting the sheet material in the regions which are free of tacky material to thereby produce a plurality of sheet material blanks.

15 Claims, 7 Drawing Figures

CUTTING SHEET MATERIAL HAVING TACKY LAYER THEREON

BACKGROUND OF THE INVENTION

1. Field of the Invention

This invention relates to methods of cutting sheet material and has particular reference to methods of cutting sheet materials with a tacky layer on them.

2. Description of the Prior Art

In the manufacture of photopolymerizable letterpress printing plates, a continuous sheet of steel is produced having a tacky layer of photopolymerizable material on its surface. Typically the sheet would be 0.010 inch thick and the tacky layer could be up to 0.070 inch thick. The sheet cannot be readily handled until the tacky layer has been allowed to dry. Drying basically involves removing the solvents from the tacky layer to enable the layer to solidify. It is not possible to heat the tacky layer to too great a temperature because bubbles will form if a critical temperature is exceeded. Since it is advisable to continuously coat a long strip of material if a uniform thickness coating is to be produced, this means that a very long sheet of steel covered with a tacky layer is produced. Because of the drying problem mentioned above, it might be thought necessary to have an extremely long production line which could enable the tacky layer to dry sufficiently to enable the sheet to be guillotined into discrete lengths.

At reasonable production rates, however, it has been found that the length of line required is more than is practicably possible.

On deciding to cut the sheet material into discrete lengths prior to drying, an investigation was made and it was discovered that there are no known methods suitable for cutting sheet materials, particularly sheet metals, which have a thick tacky layer on the surface and in particular a tacky layer of constant thickness.

SUMMARY OF THE INVENTION

The present invention provides a continuous method of manufacturing a plurality of sheet material blanks each having a surface uniformly coated with a tacky layer which comprises passing a long length of horizontally traveling sheet material through a first station in which tapes are applied to a surface of the sheet material transversely to the direction of movement of the sheet material and at longitudinally spaced-apart locations, at a second station applying a continuous layer of tacky material to the surface of the sheet material and over the tapes so that tapes mask portions of the surface, at a third station removing the tapes to leave transverse regions free of tacky material and then cutting the sheet material in the regions which are free of tacky material to thereby produce a plurality of sheet material blanks.

The tape is preferably a self-adhesive tape, and may be a pressure-sensitive adhesive tape. The tape may be masking tape or other low tack tape having a weak adhesive on a sufficiently strong tape base.

The sheet material may be metal, for example steel, and the cutting means may be a guillotine or a saw. The tacky material may be a polymeric mterial, and may be a photopolymerizable material.

The thickness of the tacky layer may be in the region of 0.020 inch to 0.2 inch. The viscosity of the tacky material may be in the range 1 to $1 \times 10^5$ poises, typically 5 or 10 to 200, or 15 to 100. Typically the viscosity may be 10, 15, 20 or 25 poises.

The sheet material may be metal, particularly steel. The long length may be in the form of a coil, which is unwound to pass through the various stations. The cutting may be performed by a saw or a guillotine, and the guillotine may be a travelling guillotine.

The tacky material forming the tacky layer may be partially dried or cured before the tape is removed, and the drying may be effected by evaporating solvents in the tacky material.

The viscosity of the tacky material may be in the range $1-10^5$, preferably 5 to 100 poises.

BRIEF DESCRIPTION OF THE DRAWINGS

By way of example, embodiments of the present invention will now be described with reference to the accompanying drawings of which.

DESCRIPTION OF PREFERRED EMBODIMENTS

Figure 1:
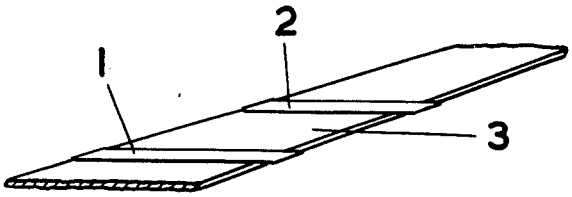
FIG. 1 is a perspective view of a steel strip divided up by lengths of tape.

When attempts were made to cut a strip of sheet steel coated with a tacky layer into lengths, the tacky layer completely prevented satisfactory operation of the cutting machine. The tacky layer adhered to the guillotine which was used, and the guillotine blade pulled away from the surface the tacky layer and distorted it to such an extent that the tacky layer was no longer smooth and uniform. This problem of cutting sheet metal having a tacky layer is particularly difficult when the tacky layer can be up to 5 times the thickness of the sheet metal. Additionally, because sheet metal requires substantial cutting apparatus, it is particularly likely to be gummed up by tacky material. To overcome this very severe problem, the sheet metal was covered at points along its length with a strip of masking tape as shown in FIG. 1. Masking tape is used commercially to mask windows, parts of structures etc prior to painting to produce a clean line between painted and unpainted surfaces. Normally, of course, masking tape is only used when the material to be applied to it has a thickness very much less than 0.001 inch.

Figure 2:
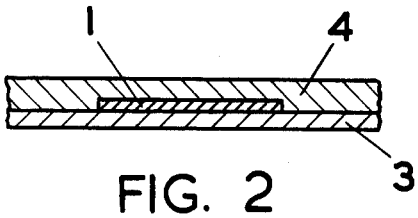
FIG. 2 is a cross-section of a strip having a tape on the upper surface and with a layer of tacky material covering them both.
Figure 3:
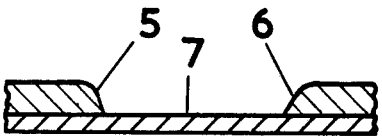
FIG. 3 is a view similar to FIG. 2 after removal of the tape.

The masking tape 1,2 was applied to the metal strip 3 as shown in FIG. 1 along the lines where the strip was to be later cut to form individual blanks. After the strip had had the lengths of tape applied, it was coated with the tacky material 4 so that the tacky material covered the tape and the tape was fully embedded in the tacky material. This situation is shown in FIG. 2. The tape was later removed to expose the clean sheet steel as shown in FIG. 3. The tacky material because of its surface tension formed a meniscus 5,6 and the tacky material did not flow into the exposed area 7. The sheet steel can then be guillotined in the exposed area by a conventional guillotine.

Figure 4:
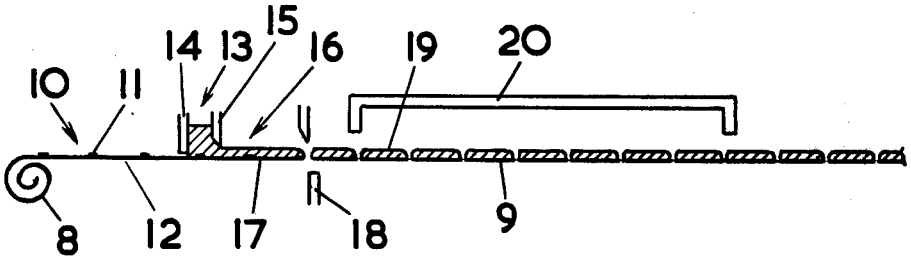
FIG. 4 is a schematic cross-section of a production line.

Referring to FIG. 4, this shows a schematic production line used to manufacture tacky layer coated sheet blanks. The tacky layer is formed of a photopolymerisable material. The sheet steel is fed from a coil 8 and extends along virtually the entire length of the production line in a horizontal uninterrupted run 9. At a first station 10 along the length of the line 9, masking tape 11 is applied to the strip. As the strip is unreeled from the coil 8, strips of masking tape are applied at regular intervals so as to produce a regular distance 12 between strips of masking tape. The strip complete with masking tape is then fed through a tacky material dispenser at a second station 13. The tacky material dispenser comprises a first wall 14 and a second wall 15 together with end walls (not shown). The bottom portion of the wall 14 touches the steel strip and has a smooth surface to permit the tapes to pass beneath the wall without being pulled off by the edge of the wall. Tacky material is continually poured into the trough formed by the walls and the end wall 15 also functions as a doctor blade to meter out a controlled thickness of tacky material onto the steep strip. The steep strip and accurately controlled tacky layer then pass to a third station 16 at which the tape is removed to reveal the surface 17. A conventional guillotine 18 then cuts through the steel sheet to form discrete blanks 19. The blanks are then fed through an oven 20 to begin the process of drying out the tacky material. Clearly, the blanks may be fed continuously through an oven or may be stacked and passed into the oven in a batch process.

Figure 5:
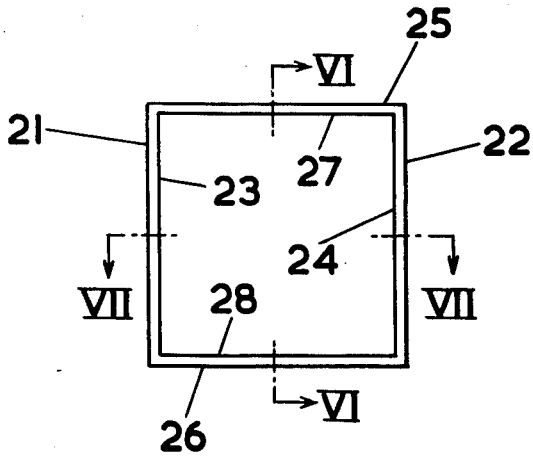
FIG. 5 is a plan view of a sheet after cutting.
Figure 6:
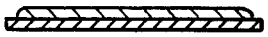
FIG. 6 is a cross-section of FIG. 5 along the line VI—VI.
Figure 7:
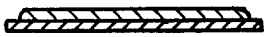
FIG. 7 is a cross-section of FIG. 5 along the line VII—VII.

In practice, the width of the steel strip is slightly greater than the width of the dispenser trough so that the tacky layer does not quite reach to either edge of the steep strip. This can be clearly seen in FIG. 5 which is a plan view of a sheet after cutting. The edges 21 and 22 of the sheet extend slightly beyond the edges 23 and 24 of the tacky layer. Similarly, the ends 25 and 26 extend beyond the ends of the tacky layer 27 and 28. This can clearly be seen in FIGS. 6 and 7.

As an alternative to masking tape, it has been found that low tack (weak adhesive) tape is particularly suitable. A cellulose transparent tape available from Sellotape Products Limited, a low tack code no 1131, is particularly useful.

The use of the tape enables the problem of cutting tacky layer coated steel to be solved simply without resort to such expedients as flame cutting torches etc which would adversely affect the steel and also the layer of polymerizable material on its surface. The guillotine and/or saw which may replace the guillotine are both cold cutting machines and do not adversely affect the photopolymerizable layer.

I claim:

1. A method of making a plurality of sheet material blanks each having a surface thereof uniformly coated with a tacky photopolymerizable layer, the method comprising the steps of:

(a) passing a long length of said sheet material horizontally through a first station in which tapes are located at desired longitudinally spaced-apart locations on said surface of the sheet material transversely to the direction of passage of said sheet material through said first station, (b) passing said sheet material with said tapes thereon horizontally through a second station at which a continuous layer of uniform tacky photopolymerizable material is applied to said surface at a constant thickness and over said tapes whereby said tapes mask transverse regions of said surface, (c) passing said sheet material horizontally through a third station in which the tapes are removed from the sheet material thereby removing strips of said tacky material from said surface to leave said transverse regions of said surface free from tacky material, (d) passing said sheet material horizontally past cutting means which cut the sheet material transversely in said transverse regions of said surface free from tacky material thereby to produce a plurality of smaller sheets of material each having on a surface thereof a uniform tacky photopolymerizable layer.

2. A method according to claim 1 in which the tapes are self-adhesive tapes.

3. A method according to claim 2 in which the tapes are pressure sensitive tapes.

4. A method according to claim 1 in which the sheet material is a metal.

5. A method according to claim 4 wherein said metal is steel.

6. A method according to claim 1 wherein the cutting means is a guillotine.

7. A method according to claim 6 wherein the guillotine is a travelling guillotine.

8. A method according to claim 1 wherein the cutting means is a saw.

9. A method according to claim 1 wherein the thickness of the tacky layer is in the region of 0.020 to 0.20 inch.

10. A method according to claim 1 wherein the viscosity of the tacky material applied in said second station is in the range 1 to $1 \times 10^5$ poises.

11. A method according to claim 10 wherein said viscosity range is from 10 to 200 poises.

12. A method according to claim 1 wherein said long length of sheet material is initially in the form of a coil thereof from which the sheet material is unwound and passed through the various stations.

13. A method according to claim 1 wherein the application of said tacky layer to said sheet material at the second station includes passing the applied layer past a doctor blade to maintain said constant thickness of the tacky layer.

14. A method according to claim 1 wherein the tacky material forming the tacky layer is partially solidified before the tapes are removed in the third station.

15. A method according to claim 14 wherein the tacky layer contains solvents and wherein solidification of said tacky layer is effected by evaporationg solvents from the tacky material.

* * * * *